United States Patent [19]

Frederick

[11] 4,356,689

[45] Nov. 2, 1982

[54] COMBINATION SPLINE COUPLING AND SPINDLE WASHER FOR ROVING FRAMES

[75] Inventor: David C. Frederick, Gastonia, N.C.

[73] Assignee: Hope Plastic Corporation, Gastonia, N.C.

[21] Appl. No.: 199,303

[22] Filed: Oct. 21, 1980

[51] Int. Cl.[3] ..... D01H 1/242; D01H 7/50

[52] U.S. Cl. ..... 57/102; 57/67

[58] Field of Search ..... 57/67–71, 57/102, 103, 96

[56] References Cited

U.S. PATENT DOCUMENTS 3,395,526 8/1968 Bookout ..... 57/102

3,748,843 7/1973 Lawson ..... 57/102

3,789,598 2/1974 Kieronski ..... 57/102 X 3,916,610 11/1975 Kieronski et al. ..... 57/102 X

*Primary Examiner*—John Petrakes

*Attorney, Agent, or Firm*—Harvey B. Jacobson

[57] ABSTRACT

A spline coupling positionable within a gear housing for coupling a flyer to the spindle gear of a spindle has an integrally attached spindle washer for effecting a seal about the spline coupling and spindle gears. The spindle washer is attached to an uppermost portion of the spline coupling and serves to prevent oil, water and lint from reaching both the spindle gear and the base of a bobbin positionable over the spindle.

8 Claims, 5 Drawing Figures

COMBINATION SPLINE COUPLING AND SPINDLE WASHER FOR ROVING FRAMES

BACKGROUND OF THE INVENTION

1. Field of the Invention

The present invention relates to textile machines utilizing a spline coupling between a flyer and spindle arrangement, and more particularly pertains to a spline coupling which is also used as a sealing means between a flyer and spindle connection.

2. Description of the Prior Art

Those concerned with the development of spline couplings, which are positionable within a gear housing attached to a flyer and engageable with a spindle gear associated with a spindle thereby to create a driving connection therebetween, have long recognized the need for reducing the amount of lint which effectively becomes entrapped within the gear housing about the spindle gear and spline coupling gear teeth. Further, there has been a long recognized need for some means of preventing spindle gear oil from coming in contact with the base of a bobbin positioned upon the spindle whereby the oil is eventually transferred to the sliver during a spinning operation. Similarly, in that many mills wet the sliver ends when starting a roving frame, a critical problem has long confronted developers as to how to prevent drops of water from running down a bobbin and, in turn, into a spindle gear. The problems of lint accumulation in a gear housing, oil contamination of a spinning sliver and water damage to a spindle gear are substantially eliminated by the present invention.

SUMMARY OF THE INVENTION

The general purpose of the present invention is to provide a spline coupling and spindle washer combination which overcomes the above-described disadvantages. To attain this purpose, the present invention provides for the use of a spline coupling and spindle washer combination which is positionable within a gear housing attached to a flyer and which is engageable with a spindle gear associated with a spindle. In this connection, the spline coupling of the present invention has concentrically aligned with and integrally attached thereto a spindle washer which effectively serves as a seal between the spline coupling and that portion of the spindle emerging therefrom for engagement with a bobbin. Through the integral attachment of the spindle washer to the spline coupling, no inertial effect is experienced as the result of centrifugal force experienced during spindle and flyer rotation, as well as bobbin stroke, which normally would cause a spindle washer to ride upward on the spindle resulting in lint, oil and water contamination.

Accordingly, it is an object of the present invention to provide for a new and improved connection means between a spindle and flyer.

Another object of the present invention is the provision of an effective seal between a flyer and spindle arrangement.

A further object of the present invention is the provision of a new and improved spline coupling having a spindle washer integrally attached thereto.

Still another object of the present invention is to provide for the alleviation of lint collection within a gear housing wherein a spline coupling effects a connection between a flyer and spindle arrangement.

A still further object of the present invention is the prevention of oil contamination of a silver associated with a bobbin as the result of oil leakage from a spindle gear.

Yet another object of the present invention is the elimination of spindle gear damage associated with water leakage from a bobbin.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
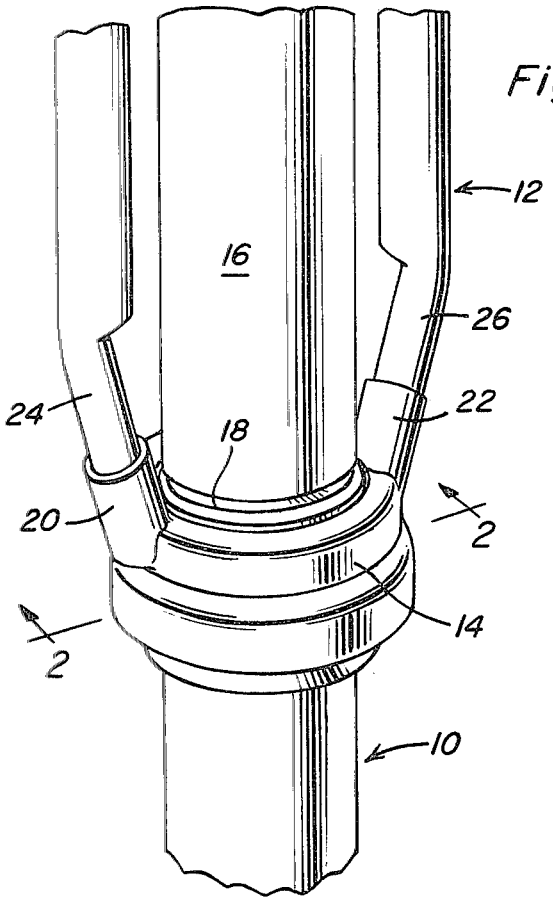
FIG. 1 is a perspective view of a bobbin and spindle arrangement having a gear housing positioned therebetween to which is attached a flyer.

Referring now to the drawings and, in particular, to FIG. 1 wherein there is illustrated in perspective a spindle 10 which is drivingly connected to a flyer 12 through unshown connection means positioned within a gear housing 14. A bobbin 16 is shown positioned over that portion of spindle 10 which emerges from the gear housing 14 through opening 18. The gear housing 14 includes a pair of upwardly extending tubular portions 20, 22, into which are insertable flyer arms 24, 26, respectively.

Figure 2:
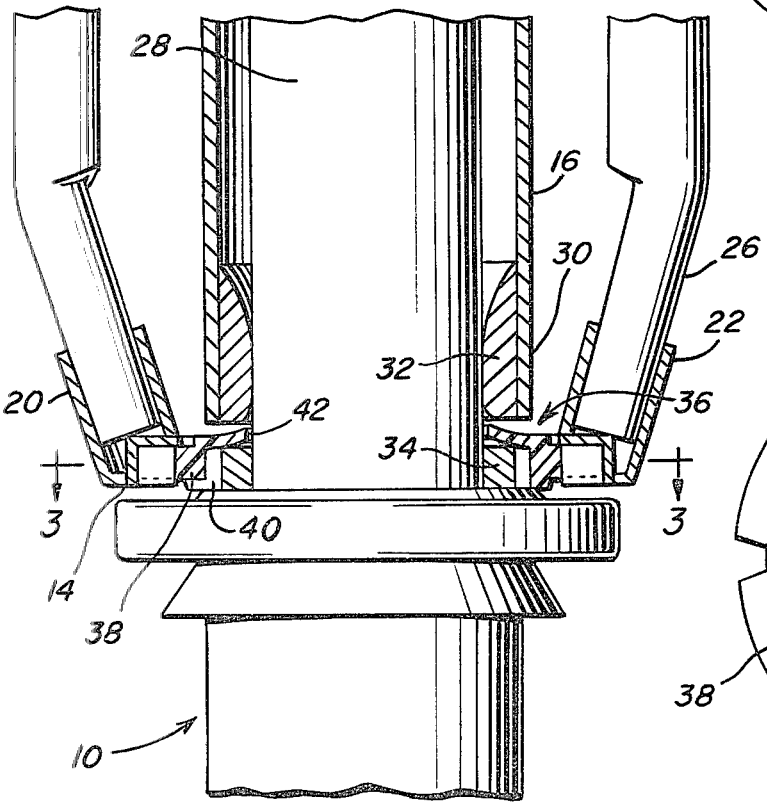
FIG. 2 is a partial cross-sectional view of the apparatus shown in FIG. 1 taken on the line 2—2.

Referring next to FIG. 2, it can be seen that the spindle 10 includes a narrow portion 28 which extends through the gear housing 14 and over which is positionable the bobbin 16. In this respect, the bobbin 16 is of a tubular construction having a hollow interior and a lower base portion 30 with resilient engaging means 32 positioned on the interior of the bobbin and proximate to the bobbin base. Typically, the resilient engagement means 32 comprises a rubber ring which is fixedly attached to the interior portion of the bobbin 16 and the center of the ring is of a lesser diameter than the narrow spindle portion 28, thereby to effect a frictional engagement between the narrow spindle portion and the bobbin.

Also illustrated in FIG. 2 is the positioning of the flyer arm 24 within tubular portion 20 of gear housing 14, as well as the positioning of flyer arm 26 within tubular portion 22. Additionally, a spindle gear 34 is shown, such gear being fixedly attached to the spindle narrow portion 28 and being in engagement with the spline coupling and spindle washer combination 36 of the present invention. In this respect, the combination 36 of the present invention includes a coupling portion 38, the teeth of which engage with the teeth of the spindle gear 34 in the area designated by the numeral 40, and a concavely upwardly-sloped spindle washer portion 42 integrally attached thereto. As can be observed with reference to FIG. 2, the spindle washer portion 42 is in close engagement with the spindle narrow portion 28 so as to protectively seal the spindle gear 34 and spline coupling portion 38 from the bobbin 16. In this regard, the spindle washer portion 42, as well as the coupling portion 38, are envisioned as being constructed of a resilient material, such as plastic or the like, to thereby facilitate the positioning and sealing effect of the combination 36 within the gear housing 14.

Figure 3:
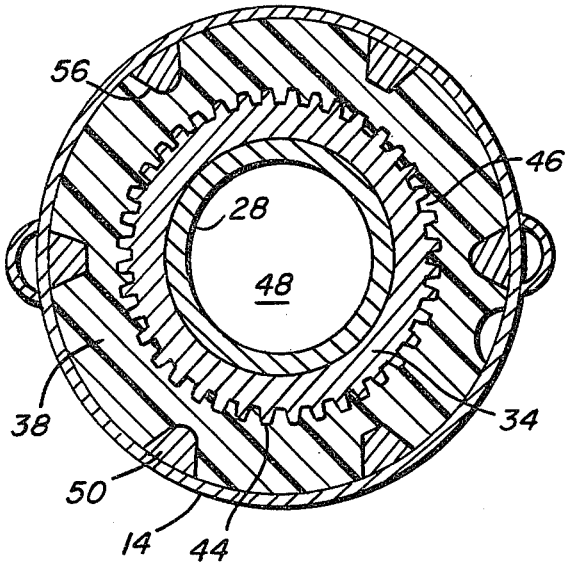
FIG. 3 is a cross-sectional plan view of the apparatus shown in FIG. 2 taken along the line 3—3.

Referring now to FIG. 3 of the drawings, it can be seen that the spindle gear 34 includes a plurality of teeth 44 which are in turn engageable with the teeth 46 associated with the spline coupling portion 38. The spindle gear 34 is concentrically aligned and fixedly attached to the narrow spindle portion 28 which is illustrated as having a hollow interior 48. The gear housing 14 includes a plurality of inwardly extending projections 50, while the spline coupling portion 38 of the present invention has a plurality of cut-outs 56 which are designed for specific alignment and engagement with the projections 50.

Figure 4:
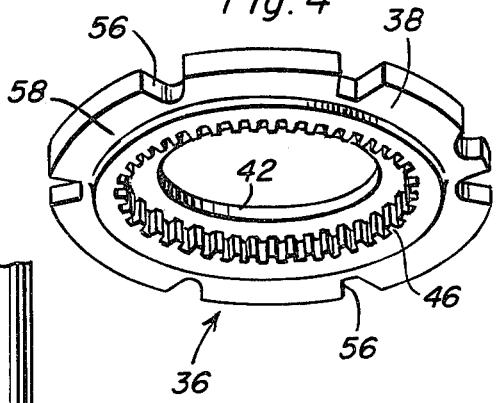
FIG. 4 is a perspective view of the spline coupling and spindle washer combination of the present invention.

A better understanding of the construction of the present invention can be obtained by reference to FIG. 4 of the drawings, which is a bottom perspective view of the spline coupling and spindle washer combination 36. In this respect, the spline coupling portion 38 is illustrated with its attendant cut-outs 56, while the spindle washer portion 42 is shown protectively positioned above the spline coupling gear teeth 46. Additionally, a downwardly extending lip portion 58 is illustrated whereby the spline coupling gear teeth 46 are integrally associated with a thicker section of the spline coupling portion 38 than are the cut-outs 56.

Figure 5:
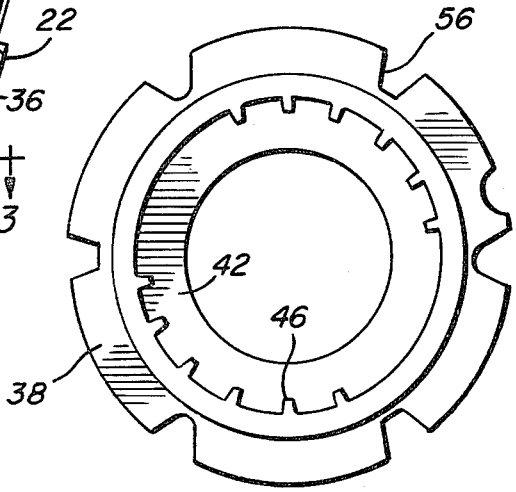
FIG. 5 is a bottom plan view of a modified embodiment of the present invention which utilizes a skip tooth spline coupling.

While FIG. 4 of the drawings illustrates an embodiment of the present invention which might be referred to as a 40-tooth spline coupling and spindle washer combination, FIG. 5 illustrates a modified embodiment in which the number of spline coupling gear teeth is varied. In this illustrated arrangement, a spindle washer portion 42 is shown from a bottom plan view as being integrally attached to a skip tooth spline coupling 60. The only variation between this embodiment of the present invention from the embodiment illustrated in FIG. 4 is the number of spline coupling gear teeth 46 associated therewith. This particular embodiment is designed to shear more readily than the 40-tooth spline coupling and as such, is illustrative of the variations possible with the spline coupling and spindle washer combination of the present invention.

In use and with reference to FIG. 2 of the drawings, it can be seen that the spline coupling and spindle washer combination 36 of the present invention serves the purpose of providing a driving engagement between the flyer 12 and spindle 10, and further serves to provide a seal between the spindle gear 34 and the bobbin 16. When positioned as illustrated within the gear housing 14, water which runs down the bobbin 16 will be prevented from coming into contact with the spindle gear 34, since the spindle washer portion 42 provides an upwardly sloping surface over which the water will be directed away from the spindle gear. Similarly, lint dropping downwardly from the bobbin 16 will also be prevented from coming into engagement with the spindle gear 34 by the spindle washer portion 42 which is integral with the spline coupling portion 38. By the same token, oil and grease which is used to lubricate the spindle gear 34 will be prevented from moving upwardly towards the bobbin 16 so as to contaminate thread contained thereon due to the positioning of the spindle washer portion 42, as illustrated.

Optimum dimensional relationships for the parts of the invention are deemed readily apparent and obvious to one skilled in the art, and all equivalent relationships to those illustrated in the drawings and described in the specification are intended to be encompassed by the invention. As such, it should be understood that the foregoing disclosure relates to only preferred embodiments of the invention and that numerous modifications or alterations may be made therein without departing from the spirit and scope of the invention as set forth in the appended claims.

What is claimed and desired to be secured by letters Patent of the United States is:

1. A spline coupling and spindle washer device for roving frames, said device comprising:

a spindle gear having gear teeth and mounted for rotation with a spindle;

spline coupling means having gear teeth for engaging the gear teeth of said spindle gear associated with said spindle, the spline coupling means coupled to rotate a flyer and thereby to effect a driving connection between said spindle gear and said flyer; and spindle washer means positioned within a gear housing and being of unitary construction with said spline coupling means and being concavely upwardly sloped, said spindle washer means thus constructed and arranged for serving to prevent oil contamination of yarn on a bobbin positioned over said spindle and to prevent water and lint contamination in an area of engagement between said spindle gear and said spline coupling means.

2. The spline coupling and spindle washer device as defined in claim 1, wherein said spline coupling means having gear teeth is a 40-tooth spline coupling, said coupling having 40 gear teeth.

3. The spline coupling and spindle washer device as defined in claim 1, wherein said spline coupling means having gear teeth is a skip tooth spline coupling.

4. The spline coupling and spindle washer device as defined in claim 1, wherein said spindle washer means is of a resilient construction.

5. The spline coupling and spindle washer device as defined in claim 1, wherein said spline coupling means is provided with cut-outs, thereby to effectively and accurately position the same with respect to said spindle gear.

6. The spline coupling and spindle washer device as defined in claim 5, wherein said spline coupling means includes a downwardly extending lip portion which defines an area of thicker construction on which said gear teeth are positioned than the construction of the thickness of the cut-outs.

7. In combination with a spindle, spindle gear, and flyer on a roving frame, a spline coupling meshing with the spindle gear and coupled to the flyer to provide a driving connection between said spindle gear and said flyer; a spindle washer positioned above the spindle gear and being of unitary construction with said spline coupling, the spindle washer having an inner edge closely surrounding the spindle below a bobbin on the spindle to prevent oil contamination of yarn on the bobbin positioned over said spindle and to prevent water and lint contamination in an area of engagement between said spindle gear and said spline coupling.

8. The invention of claim 7 wherein the spindle washer is sloped concavely upward about the spindle.

* * * * *